US006189631B1

(12) United States Patent
Sheshtawy

(10) Patent No.: US 6,189,631 B1
(45) Date of Patent: Feb. 20, 2001

(54) DRILLING TOOL WITH EXTENDABLE ELEMENTS

(76) Inventor: Adel Sheshtawy, 11706 Highgrove, Houston, TX (US) 77007

( * ) Notice: Under 35 U.S.C. 154(b), the term of this patent shall be extended for 0 days.

(21) Appl. No.: 09/191,476

(22) Filed: Nov. 12, 1998

(51) Int. Cl.[7] ..... E21B 07/28; E21B 10/32
(52) U.S. Cl. ..... 175/284; 175/321
(58) Field of Search ..... 175/321, 326, 175/325.1, 264, 284

(56) References Cited

U.S. PATENT DOCUMENTS

| | | | | |
|---|---|---|---|---|
| 1,326,509 | | 12/1919 | Humason | 175/254 |
| 1,519,039 | | 12/1924 | Morgan et al. | 175/278 |
| 1,532,330 | | 4/1925 | Mitchell | 175/285 |
| 1,750,628 | * | 3/1930 | Crum | 175/278 |
| 1,880,216 | | 10/1932 | Simmons | 175/263 |
| 1,896,105 | | 2/1933 | Simmons | 175/240 |
| 3,051,255 | | 8/1962 | Deely | 175/265 |
| 3,367,422 | * | 2/1968 | Sims | 166/187 |
| 4,064,951 | | 12/1977 | Weber | 175/45 |
| 4,273,372 | * | 6/1981 | Sheshtaway | 294/6.15 |
| 4,379,494 | * | 4/1983 | Sheshtaway | 175/325.2 |
| 4,589,504 | | 5/1986 | Simpson | 175/267 |
| 4,660,657 | | 4/1987 | Furse et al. | 175/269 |
| 4,751,972 | * | 6/1988 | Jones et al. | 175/329 |
| 4,842,082 | * | 6/1989 | Springer | 175/279 |
| 5,090,480 | | 2/1992 | Pittard et al. | 166/298 |
| 5,311,953 | * | 5/1994 | Walker | 175/61 |
| 5,419,935 | * | 5/1995 | Harvey et al. | 166/241.6 |
| 5,456,312 | | 10/1995 | Lynde et al. | 166/55.6 |
| 5,755,299 | * | 5/1998 | Langford, Jr. et al. | 175/375 |
| 5,788,000 | * | 8/1998 | Maury et al. | 175/325.1 |
| 5,911,285 | * | 6/1999 | Stewart et al. | 175/317 |
| 5,944,129 | * | 8/1999 | Jensen | 175/430 |

* cited by examiner

*Primary Examiner*—David Bagnell
*Assistant Examiner*—Jennifer R. Dougherty
(74) *Attorney, Agent, or Firm*—Strasburger & Price, LLP; John G. Fischer

(57) ABSTRACT

A tool for expanding a hole size while drilling tool is disclosed. The tool utilizes a mechanically actuated mandrel and extendable cutting lugs designed in a configuration with fewer moving parts than previous designs. The cutting lugs have multiple cutting elements attached. The cutting lugs are driven between two cylindrical diameter surfaces to achieve a large differential between the retracted and extended positions of the tool, and to provide sufficient stability to allow the tool to be used in the extended position while drilling forward. The lugs are internally assembled and tapered to closely match the slots in the body of the tool for additional stability and to prevent complete passage through the tool for prevention of catastrophic failure. The tool has a locking mechanism to allow the tool to remain in the extended position when the weight is removed from the tool. In an alternate embodiment, the cutting lugs may be replaced with stabilizing lugs having a wear resistant surface or mounted with wear resistant elements to form an expanding drill string stabilizer.

73 Claims, 3 Drawing Sheets

DRILLING TOOL WITH EXTENDABLE ELEMENTS

TECHNICAL FIELD

This invention relates generally to drilling tools used in the drilling of oil and gas wells, or similar drilling operations, and in particular to a tool that can drill a hole diameter larger than the inside diameter (ID) or the drift diameter (DD) of the casing or pipe installed in the well above the hole being drilled. Such tools are commonly known as Underreamers. Additionally this tool relates to drilling tools known as expandable stabilizers.

BACKGROUND

When drilling through subterranean formations in the exploration for oil and gas, it is common practice to drill larger diameter holes at the surface, and successively smaller diameter holes as the well is drilled deeper. When the desired depth is reached for a given wellbore diameter, a tubular casing is cemented in place. This practice allows for the protection of water tables from drilling and production fluids, improves drilling and production efficiency, and protects the wellbore. It is often desirable to drill a hole larger than the inside diameter of the last casing that was set, at some known depth below the surface. This may be desirable, for example, for setting additional casing below this known depth, which will require drilling an annular well bore diameter sufficient for cementing of the lower casing. This creates a special drilling situation since conventional drill bits of the size needed to generate the desired well bore diameter will not fit inside the casing that has already been set. Tools used for these applications are commonly known as underreamers. Other applications for underreamers include enlarging zones for gravel pack completions or to compensate for plastic flow of salt and shale formations.

Two principal tools are commonly used in the drilling industry to achieve the objective of drilling the well bore diameter larger than the drift diameter of the casing. The first tool used for this purpose is known as the "Bi-center bit." The Bi-center bit is an undersized drill bit with a large eccentric cutting structure located off-center above a smaller pilot drill bit that is centered axially with the drill collars. Fielder discloses such a device in U.S. Pat. No. 5,678,644. The Bi-center bit is sized so that while running it into the hole, the smaller pilot bit will be pushed to one side to allow the tool to pass through the inside of the casing. When the Bi-center bit reaches the bottom of the hole, the pilot bit acts as a centered pivot point for the eccentric cutting structure above it. When drilling, the eccentric cutting structure will then rotate around the pilot bit and generate a larger hole than the inside (or drift diameter) of the casing.

Problems are frequently associated with the use of the Bi-center bit. For example, when drilling a soft formation, the pilot bit will be forced the one side of the hole opposite the larger eccentric cutting structure and the resultant hole drilled will be smaller than required. The offset design of the Bi-center bit results in uneven wear of the cutting structure and lower rates of penetration. Furthermore, the torque generated during the use of Bi-center bits fluctuates and can have a damaging effect on the drill string, and the tool is unreliable in controlling the angle of the hole. An additional limitation is the inability of the Bi-center bit to drill out cement or a casing shoe. Due to this limitation, an extra trip is required to drill out cement or a casing shoe when using Bi-center bits.

The second tool used for the purpose of drilling a section of the well bore diameter larger than the drift diameter of the casing is an underreamer. A typical underreamer includes extendable arms pivotally mounted in a housing on hinge pins for movement between a retracted position and an extended position. The underreamer may be hydraulically or mechanically actuated. While the underreamer is being lowered into the hole, the arms will be in the collapsed or retracted position to permit the tool to pass through the inside diameter of the casing. When the underreamer reaches the depth at which it is desirable to increase the well bore diameter, the arms of the underreamer are hydraulically or mechanically actuated into the extended position.

In the past, most underreamers utilized roller cone type cutters. Weber discloses such a device in U.S. Pat. No. 4,064,951. These devices were limited in their effectiveness in many formations, and unreliable as a result of the numerous moving components and sealing systems required for their construction. Roller cone type cutters require bearing systems. The most reliable roller cone cutters also required a lubrication and sealing system. Furthermore, the component parts were subject to breakage that resulted in costly operations to remove the debris from the bottom of the hole. More recently, attempts have been made to build underreamers which utilize synthetic diamond material. Simpson discloses such a device in U.S. Pat. No. 4,589,504. These underreamers were also prone to breakage of the support arms and cutting elements that resulted in costly operations to remove the debris from the bottom of the hole.

Other underreamer designs have been designed to perform only reaming operations to prevent bit sticking, and are of a type that includes a long conical tapered body attached by splines in a conical shell. Deely discloses such a device in U.S. Pat. No. 3,051,255. These tools were designed to improve wellbore concentricity and ensure that the drill bit does not get stuck. Such devices have suffered from difficulties in their manufacture as related to the design, as well as operational limitations. In particular, underreamers that incorporate long tubular sections which are internally tapered are extremely difficult to manufacture with quality tolerances. The inner surface of the cutting lugs cannot mate uniformly with the length of the conical surface traversing the inner surface of the cutting lugs. Another disadvantage of this design is that the radial forces imparted to the cutting lugs generate resultant forces that remove weight from the bit and urge the tool to disengage and return to the retracted position. The result is an unstable tool that cannot tolerate the shock and vibration associated with simultaneous drilling. Another disadvantage of these tools is that they are severely limited in their total expansion capability and are not capable of enlarging the wellbore by any significant amount.

A primary limitation of past underreamer designs has been the necessity to first drill a pilot hole with a conventional drill bit, then remove the entire drill string, assemble the underreamer onto the drill string, and then begin the underreaming operation. This two step drilling process is slow and costly.

Expandable stabilizers may be used during operations designed to increase the hole diameter. The principals and design solutions known to the industry for the construction of underreamers also apply to the construction of expandable stabilizers. The primary difference is that cutting elements are replaced with wear elements.

It is seen that there is a need for a tool with greater strength and reliability to overcome the disadvantages and limitations commonly associated with conventional bi-center bits, underreamers, and expandable stabilizers of the general configurations described above.

SUMMARY OF THE INVENTION

In the preferred embodiment, the invention provides a tool that is capable of enlarging the hole while drilling, that overcomes many of the deficiencies of past underreamer designs and Bi-center bits as previously noted. It is on the basis of this unique ability that the inventor has designated the tool as the "EWD" which is an acronym for "Enlarging-while-drilling." In an alternative embodiment, the tool operates as an expandable stabilizer.

Configured as an enlarging-while-drilling tool, the current design provides an extremely stable configuration with far fewer moving parts and a higher degree of reliability than previous designs. As a result of the stability, and unique internal assembly of the invention, the risk of breakage and disaster is substantially reduced, since it is impossible for a cutting lug to fall from the body of the enlarging-while-drilling tool. Additionally, the stability of the preferred embodiment allows for a greater extension of the cutting lugs and enables the operator of the invention to expand the well bore in a greater amount than previous designs. For example, a 12¼" wellbore can be enlarged to 14¾" with this tool. The greater strength and stability of this tool permits the operator to continue to drill a deeper hole while simultaneously enlarging the wellbore. This eliminates the need to drill a pilot hole with a conventional drill bit, then remove the entire drill string, assemble the underreamer onto the drill string, and then begin the underreaming operation.

The drilling tool with extendable elements accomplishes the above noted operating features. The tool is an assembly of tubular sections that are attached to each other by threaded connections in a vertical alignment. As assembled, there is a continuous path for the flow of drilling fluid through the tool.

The tool is delivered into the casing in the retracted position. A shear pin holds the tool in the retracted position while drilling out cement and the casing shoe. When the tool reaches the desired depth in the well bore, the tool may be extended by application of the required weight known to shear the pin. Actuation of the tool results in extension of a plurality of cutting lugs sliding radially outward from the tool. When the tool is actuated, a mandrel assembly moves downwardly relative to a housing assembly. A tapered shaft portion engages matchingly tapered inner surface portions of the cutting lugs, and forces the cutting lugs outward through longitudinal slots in the housing assembly. The cutting lugs move radially outward until a cylindrical shaft portion engages a matchingly curved inner surface portion of the cutting lugs. With the cutting lugs extended, the tool will enlarge a hole to a substantially larger diameter than the drift diameter of the casing through which it passed. When configured for extended stabilization, the cutting lugs are simply replaced with stabilizing lugs, and the nozzle receptacles are plugged to increase the flow of drilling fluid through the tool. The stabilizing lugs each have a wear surface attached to their exterior surface. The wear surface may be a hardmetal or attachment of wear elements such as diamonds or tungsten carbide inserts.

DESCRIPTION

Figure 1:
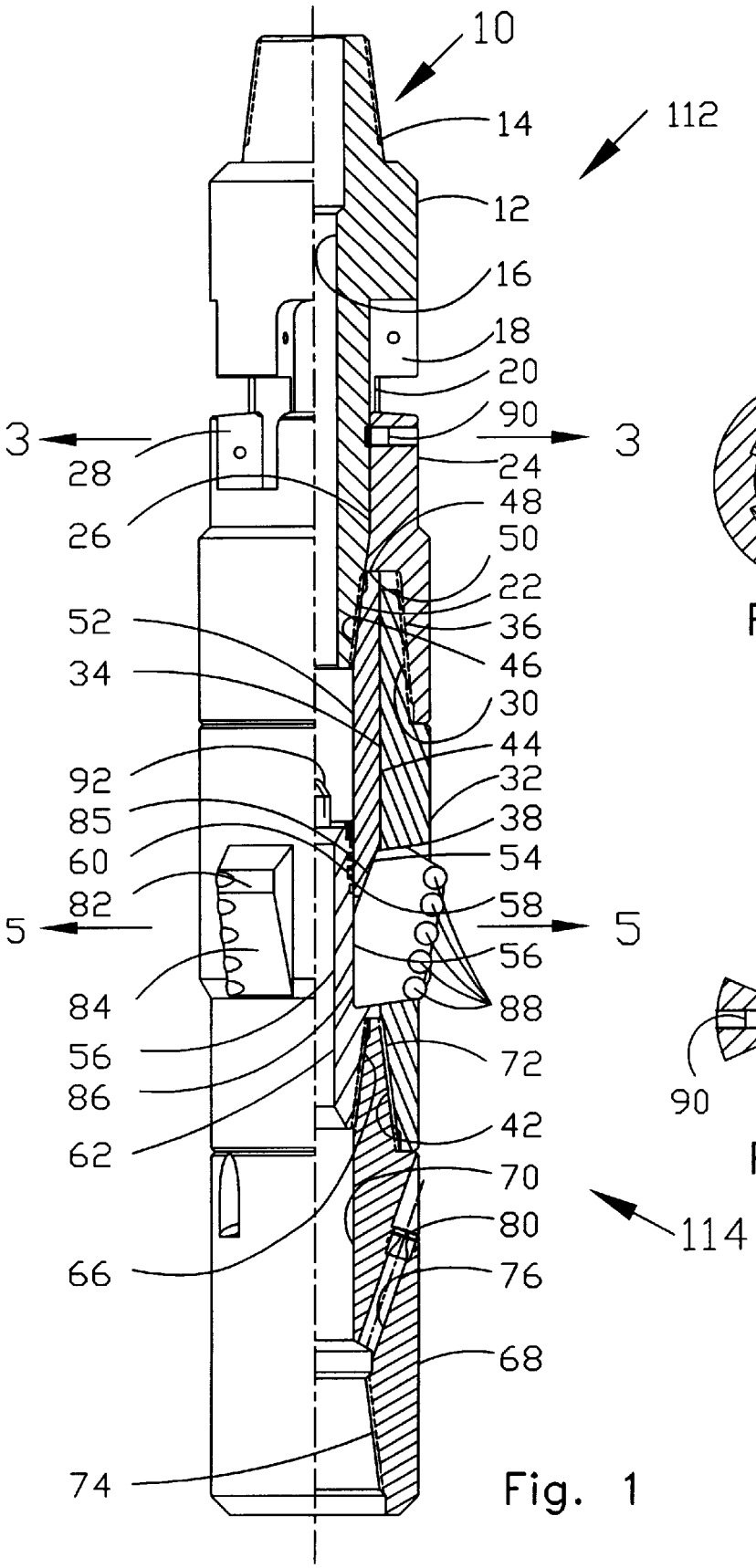
FIG. 1 is a half-section of the tool in the retracted position. This is the position in which the tool would normally be lowered into the well. In the retracted position, the cutting elements are positioned radially at a distance that is less than the inside diameter of the casing.
Figure 2:
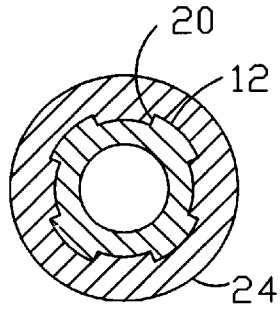
FIG. 2 is a cross section as indicated in FIG. 4.
Figure 3:
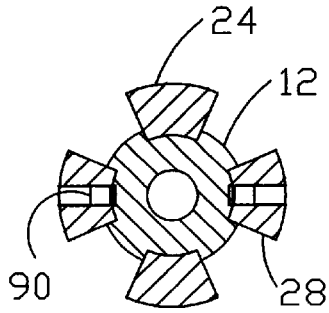
FIG. 3 is a cross section as indicated in FIG. 1.
Figure 4:
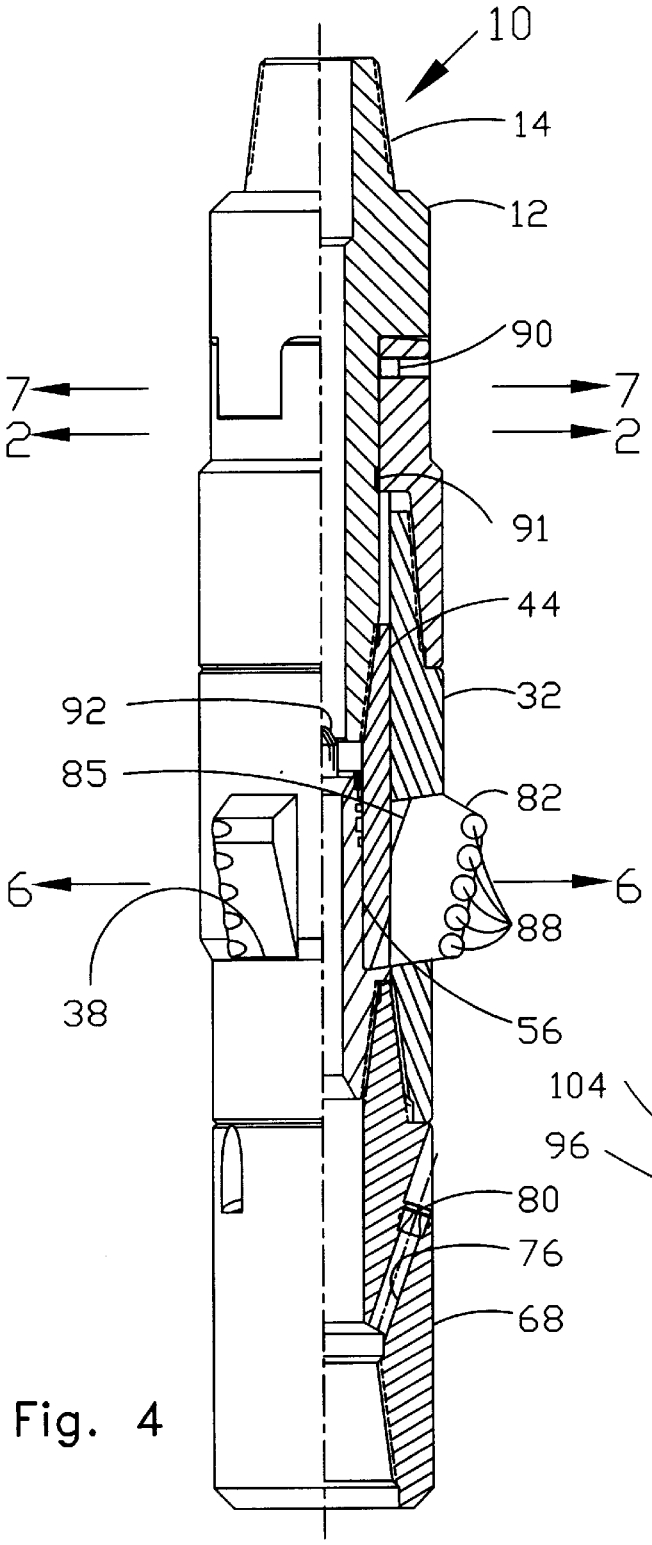
FIG. 4 is a half-section view of the tool in the extended position. In this position the cutting lugs will act to enlarge the hole diameter.

Referring to FIGS. 1 and 4, the reference numeral 10 generally designates the enlarging-while-drilling (EWD) tool, embodying features of the preferred embodiment. The EWD tool 10 includes a tubular drive shaft 12 which has at its top end a threaded upper drive shaft connection 14 configured for connection to a drill string component (not shown). Referring to FIG. 1, drive shaft 12 has a longitudinal drive shaft central bore 16 throughout for the passage of drilling fluid. A plurality of drive lugs 18 extend downwardly from drive shaft 12. An externally splined shaft 20 extends below drive lugs 18. A threaded lower drive shaft connection 22 is below splined shaft 20.

Located directly beneath, and in vertically slidable relationship with drive shaft 12 is a tubular drive cap 24 having an internally splined center section 26 which engages splined shaft 20 to provide a vertically slidable connection between drive shaft 12 and drive cap 24 to transmit rotation of the drill string through tool 10 when tool 10 is in a retracted position. Downwardly facing drive lugs 18 on drive shaft 12 align with and engage complimentarily opposing drive slots 28 on top of drive cap 24. This occurs upon axial movement of drive shaft 12 toward drive cap 24 during actuation of tool 10, as will be described hereinafter. At the bottom of drive cap 24 is a threaded drive cap connection 30.

Figure 5:
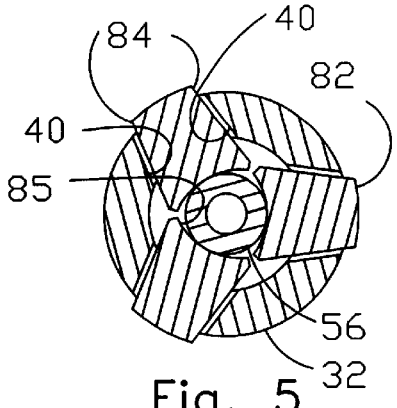
FIG. 5 is a cross section as indicated in FIG. 1.

Directly beneath drive cap 24, is a tubular upper housing 32 having a longitudinal upper housing central bore 34. On top of upper housing 32 is a threaded upper housing top connection 36, which is threadedly connected to drive cap connection 30. Upper housing 32 has a plurality of longitudinal slots 38 that intersect upper housing central bore 34 and extend to the exterior of upper housing 32. Referring to FIG. 5, a tapered perimeter 40 is formed along each of longitudinal slots 38. Tapered perimeter 40 is outwardly reducing, such that the perimeter opening longitudinal slots 38 form at the interior surface of upper housing central bore 36 is greater than the perimeter opening longitudinal slots 38 form at the exterior surface of upper housing 32. Referring to FIG. 1, at the bottom of upper housing 32 is a threaded upper housing bottom connection 42.

Attached to the bottom of drive shaft 12 is a tubular upper mandrel 44 having a threaded upper mandrel connection 46 at its top end and being threadedly connected to lower drive shaft connection 22. An upwardly facing mandrel shoulder 48 is formed at the upper end of mandrel connection 46. Likewise, an opposing downwardly facing drive cap shoulder 50 is formed between upper housing top connection 36 and splined center section 26. Mandrel shoulder 48 and drive cap shoulder 50 engage to carry tensile force through tool 10 when tool 10 is suspended by upper drive shaft connection 14. Upper mandrel 44 is vertically slidable within upper housing central bore 34. Upper mandrel 44 has a longitudinal upper mandrel central bore 52, and has an externally tapered bottom 54.

A tubular lower mandrel 56 is located vertically slidable within upper mandrel central bore 52, and has at its top end external circumferential grooves 58 for sealing against upper mandrel central bore 52. Seals 60 effect a fluid tight seal between lower mandrel 56 and upper mandrel 44. Lower mandrel 56 has a longitudinal lower mandrel central bore 62 for passage of drilling fluid, and a lower mandrel threaded connection 66 on its bottom end.

A tubular lower housing 68 has a longitudinal lower housing central bore 70. At the top of lower housing 68 is an external-internal double thread connection 72 for complementary threaded connection to upper housing bottom connection 42, and simultaneous complementary connection to lower mandrel connection 66 at the bottom end of lower mandrel 56. Lower housing 68 has a lower housing threaded connection 74 on its bottom end for attachment of a drill bit or other drill string portion (not shown). Lower housing 68 has at least one fluid course 76 intersecting lower housing central bore 70, and directed upwards. A nozzle 80 is located at the radial end of each fluid course 76.

Figure 6:
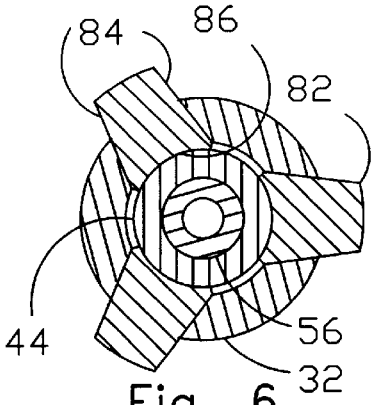
FIG. 6 is a cross section as indicated in FIG. 4.

A cutting lug 82 is located in each of longitudinal slots 38. Each of cutting lugs 82 must be positioned in longitudinal slots 38 from the inside of tool 10, and are slidable radially of tool 10 between the retracted and extended positions as will be described further. As seen in FIG. 1, cutting lugs 82 have a conically tapered surface 85 that matches externally tapered bottom 54 of upper mandrel 44. As seen in FIG. 6, the inner most surface of cutting lugs 82 has a curved inner surface 86 which matches the cylindrical outside surface of upper mandrel 44. As can be seen in FIG. 5 and FIG. 6, cutting lugs 82 have an exterior taper 84, such that exterior taper 84 permits cutting lugs 82 to extend a limited distance through longitudinal slots 38 before matchingly engaging tapered perimeter 40 of longitudinal slots 38. As can be seen in FIG. 4, the bottoms of cutting lugs 82 are downwardly angular in the direction of the central axis of tool 10, and in angular matching and sliding contact with tapered perimeter 40 of longitudinal slots 38, such that without other forces in effect, gravity will force cutting lugs 82 to slide downwardly and radially inward, towards the center of tool 10. The angular relationship between tapered perimeter 40 and exterior taper 84 is designed to stabilize cutting lugs 82 in the extended position, prevent entrance of drilling debris into the interior of tool 10 in both extended and retracted positions, and to eliminate any possibility of cutting lugs 82 falling into the hole.

Cutting lugs 82 have a plurality of cutting elements 88 which may be polycrystalline diamond compact (PDC) cutters, natural diamonds, tungsten carbide inserts or other wear resistant material mounted to engage and enlarge the well bore as tool 10 is rotated and progresses downwardly through the well bore in the extended position.

One or more shear pins 90 are placed between drive shaft 12 and drive cap 24 to keep tool 10 in the retracted position until the predetermined weight required to sever shear pins 90 is applied. In this manner, tool 10 can remain in the retracted position while all of the weight necessary is applied to a conventional drill bit to drill out the cement and casing shoe.

Referring to FIG. 4, an end 91 of shear pin 90 has been sheared off, and drive shaft 12 and upper mandrel 44 have moved downwardly to position upper mandrel 44 inside cutting lugs 82 to extend cutting lugs 82 to the desired diameter to underream the well bore as tool 10 rotates and progresses down the hole.

Pressure indicator 92 is supported on the top end of lower mandrel 56, and has openings to allow passage of mud during drilling operations.

Figure 7:
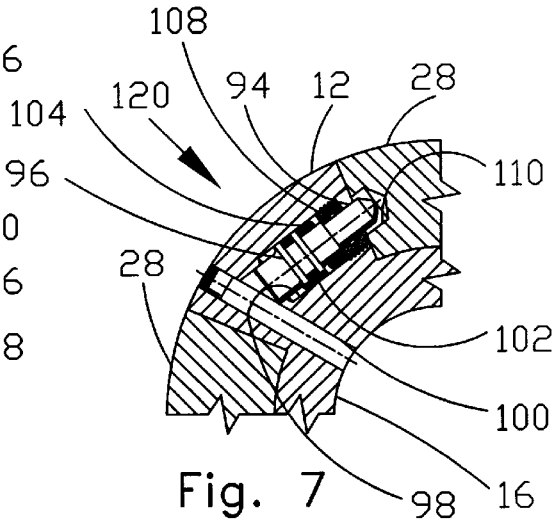
FIG. 7 is a partial, enlarged cross section as indicated in FIG. 4.

Referring to FIG. 7, tool 10 is shown in the extended position, and a hydraulic lock pin assembly 120 is illustrated. A lock pin 94 is incorporated in drive shaft 12. Piston 96 is integral with lock pin 94 and positioned in a bore 98 in communication with a radial hole 100. An O-ring 102 seals between piston 96 and bore 98. A spring 104 is positioned between a retainer 108 and piston 96 and urges piston 96 to a retracted position. The drilling fluid circulating inside tool 10 passes through radial hole 100 and bore 98 to exert pressure on piston 96, compress spring 104 and to extend pin 94. When extended, pin 94 engages a pin hole 110 in drive cap 24 to lock tool 10 in an extended position as shown in FIGS. 4 and 7.

In this embodiment, a mandrel assembly 112 comprises a drive shaft 12 and an upper mandrel 44, and a housing assembly 114 comprises a drive cap 24, upper housing 32, lower housing 68, and lower mandrel 56. Mandrel assembly 112 and housing assembly 114 are located in longitudinally slidable and sealing relation. It can be seen that the numerous connections between the tubular sections in this embodiment may be arranged differently to accomplish the same result. For example, in an alternative embodiment, not shown, mandrel assembly 112 includes lower mandrel 56.

Figure 8:
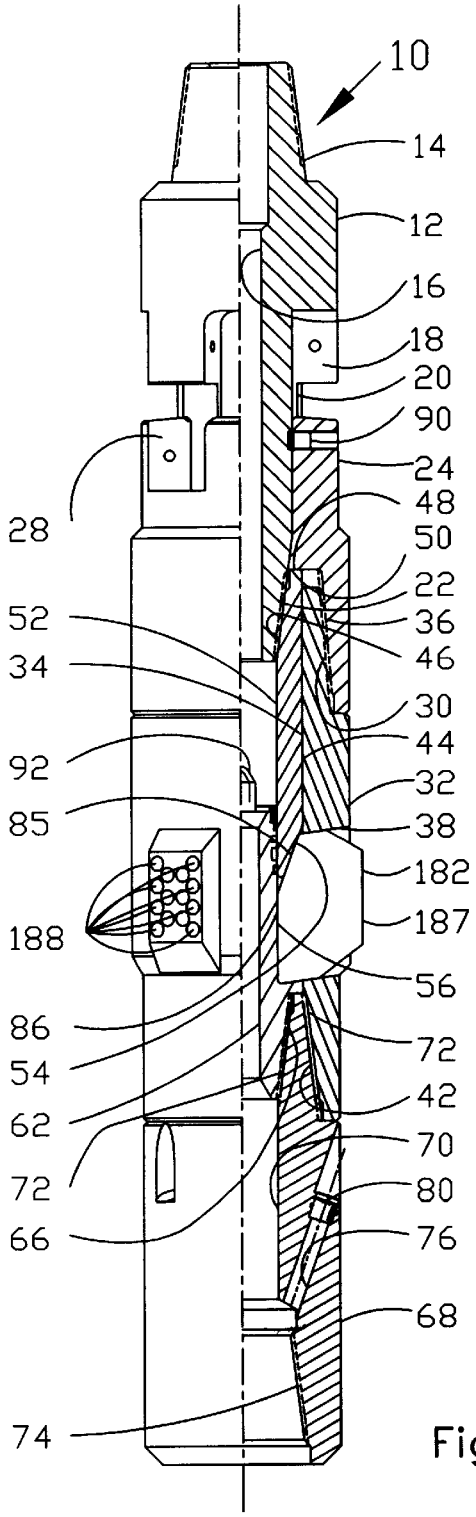
FIG. 8 is a half-section of the tool configured as an expandable stabilizer, the alternate embodiment of the tool, in the retracted position. This is the position in which the tool would normally be lowered into the well. In the retracted position, the stabilizer elements are positioned radially at a distance that is less than the inside diameter of the casing.
Figure 9:
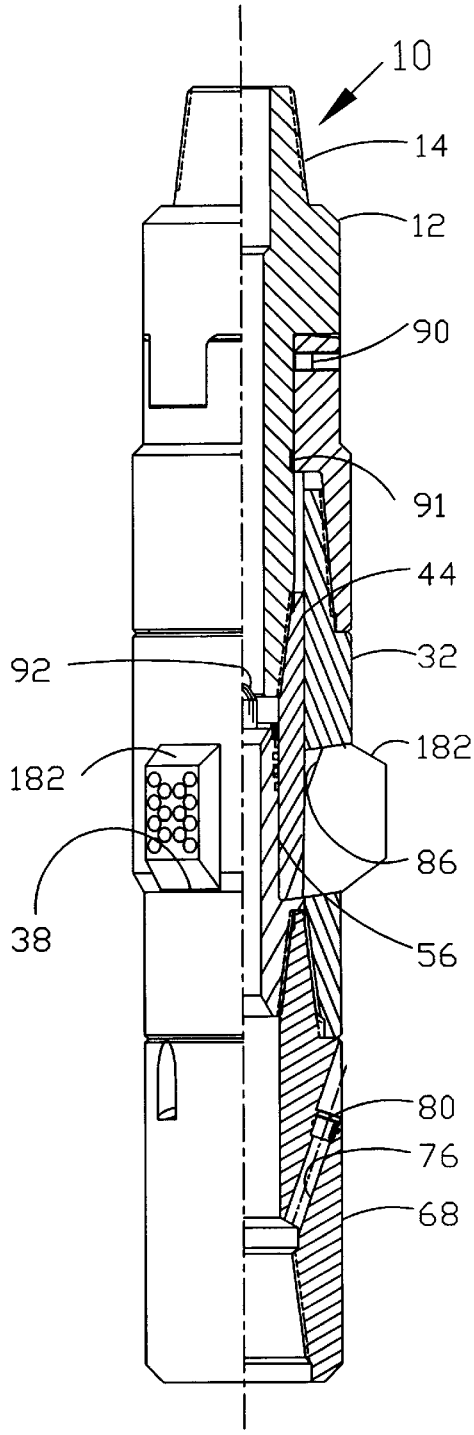
FIG. 9 is a half-section of the tool configured as an expandable stabilizer in the extended position. In this position the stabilizer lugs will act to stabilize the tool and the drill string by engagement with the hole diameter.

In an alternative embodiment, shown in FIG. 8 and FIG. 9, drilling tool with extendable elements 10 is shown configured to operate as an expandable stabilizer by replacing internally assembled cutting lugs 82 with internally assembled stabilizer lugs 182. Stabilizer lugs 182 have an external wear surface 187 which may be created by coating the external surface of stabilizer lugs 182 with a hardmetal, or by attachment of a plurality of wear elements 188 to each stabilizer lug 182. Additionally, when tool 10 is configured as an expandable stabilizer, flow course 68 and nozzle receptacle 80 are unnecessary and may be plugged if desired to increase the flow of drilling fluid to the drill bit (not shown).

OPERATION

In the operation of the preferred embodiment, the EWD tool 10 is configured as an enlarging-while-drilling tool. Tool 10 is connected to a drill string (not shown). Rotation of the drill string rotates the drilling tool with extendable elements 10. In the retracted position, cutting lugs 82 are supported at conically tapered surface 85 by engagement with externally tapered bottom 54 of upper mandrel 44, and at curved inner surface 86 by engagement with lower mandrel 56. When the predetermined weight required to shear pin 90 is applied, tool 10 is actuated. When tool 10 is actuated, drive shaft 12 and upper mandrel 44 are forced downwardly relative to drive cap 24, upper housing 32, lower housing 68, and lower mandrel 56. In the downward movement, externally tapered bottom 54 of upper mandrel 44 traverses conically tapered surface 85, forcing cutting lugs 82 radially outward until the outside surface of upper mandrel 44 engages curved inner surface 86. As shown in FIG. 6, in the fully extended position, curved inner surface 86 is matchingly supported by the outside surface of upper mandrel 44, positioning cutter lug 82 in full extension to cut the well bore to the larger diameter desired. As seen in FIG. 6, in the fully extended position, tapered exterior perimeter 84 of each cutting lug 82 is in substantially full perimeter engagement with tapered perimeter 40 of longitudinal slots 38 so as to prevent the complete passage of cutting lugs 82 through longitudinal slots 38, and to securely support cutting lugs 82 while preventing intrusion of drilling fluid debris into the interior of tool 10. As seen in FIG. 6, the vertical portion of tapered exterior perimeter 84 of each cutting lug 82 is tapered, as is the vertical portion of longitudinal slots 38 to maximize the surface contact area and stability between cutting lugs 82 and longitudinal slots 38 when tool 10 is in the extended position.

Drive lugs 18 are engaged with drive slots 24 to provide high torque, increased wear area, and increased strength of engagement. In this position splined shaft 20 and splined center section 26 do not have to carry all the drilling torque which is subject to great vibration and variation.

As drive shaft 12 is forced downwardly to actuate tool 10 into the extended position, drive shaft central bore 16 moves into close proximity with pressure indicator 92, restricting the flow area for the drilling fluid, as shown in FIG. 4. This restricted flow area causes a relative increase in the fluid circulating pressure at the surface, which is an indication that tool 10 is in the fully extended position. Pressure indicator 92 may be attached to either lower mandrel 56 or drive shaft 12 to achieve the same result.

In the extended position, there remains a continuous flow path through tool 10. As drilling fluid passes through lower housing 68 a portion of the drilling fluid will enter flow course 76 and exit nozzle receptacle 80 which is aligned in the direction of cutting elements 88 to help cool and clean cutting elements 88 during expanding while drilling operations.

When tool 10 has been moved into the extended position and drilling operations have begun, the drilling fluid pressure internal to tool 10 will increase as the flow rate is increased, imposing pressure on piston 96 through radial hole 100 and bore 98. Piston 96 will extend into bore hole 110 to lock tool 10 in the extended position. If a soft formation is encountered, and little weight is required to operate tool 10, pin 94 engaged in bore hole 110 will prevent tool 10 from returning to the retracted position. When both weight and circulating pressure are removed from tool 10, tool 10 may be retracted. With tool 10 in the retracted position, circulation of drilling fluid will not be similarly restricted by pressure indicator 92, and the same flow rate will result in a relative decrease in the fluid circulating pressure at the surface, indicating that tool 10 is in the retracted position.

EWD tool 10 can be configured to operate as an expandable stabilizer by simply replacing internally assembled cutting lugs 82 with internally assembled stabilizer lugs 182, and by optionally plugging nozzle receptacle 80. Stabilizer lugs 182 are then actuated in the same manner as cutting lugs 82 in the Preferred Embodiment. The operation of tool 10 is precisely the same as the preferred embodiment, except that tool 10 will act as a drill string stabilizer.

Although an exemplary embodiment of the invention has been disclosed for purposes of illustration, it will be understood that various changes, modifications, and substitutions may be incorporated into such embodiment without departing from the spirit of the invention as defined by the claims appearing hereinafter.

I claim:

1. A drilling tool with extendable elements, being movable between a retracted position and an extended position, comprising:

a mandrel assembly having an upper connection at the top for attachment to a drill string component, a central bore throughout, and an upper mandrel portion having an externally tapered bottom;

a housing assembly located in axially slidable, and rotationally engaged relation with the mandrel assembly, a central bore throughout, a plurality of slots, and a connection at its bottom for attachment to a drill string component; and, a plurality of lugs located one each within the slots, the lugs having a conically tapered surface engagable with the externally tapered bottom when the tool is in the retracted position, the lugs having curved inner surfaces engaging the upper mandrel portion when the tool is in the extended position.

2. A drilling tool with extendable elements, as described in claim 1, further comprising:

the mandrel assembly having a plurality of drive lugs facing downwardly, and a splined shaft extending downwardly of the drive lugs; and, the housing assembly having a plurality of upwardly facing drive slots for complimentary engagement with the drive lugs when the tool is in the extended position, and an internally splined center section located in slidable engagement with the splined shaft.

3. A drilling tool with extendable elements, as described in claim 1, further comprising:

the housing assembly having a tubular lower mandrel portion, located in axial slidable engagement with the upper mandrel; and, the curved inner surfaces engagable with the outside diameter of the tubular lower mandrel when the tool is in a retracted position.

4. The drilling tool with extendable elements, according to claim 1, further comprising:

the mandrel assembly having an upwardly facing mandrel shoulder; and, the housing assembly having a downwardly facing drive cap shoulder such that when a lifting force is applied to the upper connection, the mandrel shoulder engages the drive cap shoulder to transmit the lifting force to the housing assembly.

5. The drilling tool with extendable elements, according to claim 1, wherein each of the lugs has an exterior taper along the majority of its perimeter such that the distance a lug may extend through a slot is limited by engagement with the slot.

6. The drilling tool with extendable elements, according to claim 1, wherein;

each of the lugs has an exterior taper along the majority of its perimeter; and, each of the slots extends in tapered reduction radially outwardly along the majority of its perimeter, such that the distance a lug may extend through a slot is limited by substantial engagement of the lug perimeter with the slot perimeter.

7. The drilling tool with extendable elements, according to claim 1, further comprising:

a plurality of cutting elements attached to the surface of each of the lugs, wherein the hardness of the cutting element material is harder than the material in the wellbore to be enlarged.

8. The drilling tool with extendable elements, according to claim 7, wherein the plurality of cutting elements comprises tungsten carbide inserts.

9. The drilling tool with extendable elements, according to claim 7, wherein the plurality of cutting elements comprises polycrystalline diamond compact cutters.

10. The drilling tool with extendable elements, according to claim 7, wherein the plurality of cutting elements comprises natural diamonds.

11. The drilling tool with extendable elements, according to claim 1, further comprising:

a stabilizer wear surface attached to the surface of each of the lugs, wherein the hardness of the wear surface is harder than the material in the wellbore to be engaged.

12. The drilling tool with extendable elements, according to claim 11, wherein the stabilizer wear surface comprises a coating of a hardmetal.

13. The drilling tool with extendable elements, according to claim 11, wherein the stabilizer wear surface comprises a plurality of tungsten carbide inserts.

14. The drilling tool with extendable elements, according to claim 11, wherein the stabilizer wear surface comprises a plurality of polycrystalline diamond compacts.

15. The drilling tool with extendable elements, according to claim 11, wherein the stabilizer wear surface comprises a plurality of natural diamonds.

16. The drilling tool with extendable elements, according to claim 1, further comprising:

at least one shear pin located between the mandrel assembly and the housing assembly to retain the tool in the retracted position until the shear pin is sheared by applying at least a predetermined minimum weight on the tool.

17. The drilling tool with extendable elements, according to claim 1, further comprising:

a pressure indicator comprising a flow restricting device located inside of the mandrel assembly central bore such that upon relative movement of the mandrel assembly towards the housing assembly, the pressure indicator causes a detectable increase in pressure associated with moving the tool from the retracted position to the extended position.

18. The drilling tool with extendable elements, according to claim 1, wherein the housing assembly further comprises:

at least one fluid course intersecting the housing assembly central bore and being directed upwards to the exterior of the housing assembly; and, a nozzle receptacle at the radial end of each fluid course in the housing assembly.

19. The drilling tool with extendable elements, according to claim 1, further comprising:

a hydraulic lock pin assembly located in the mandrel assembly, having a hydraulic piston responsive to fluid pressure in the tool; and, a bore hole in the mandrel assembly to receive the hydraulic piston to lock the tool in the extended position.

20. A drilling tool with extendable elements, being movable between a retracted position and an extended position, comprising:

a mandrel assembly having an upper connection at the top for attachment to a drill string component, a central bore throughout, a plurality of drive lugs facing downwardly, and a splined shaft extending downwardly of the drive lugs;

a housing assembly located beneath the mandrel assembly, having a central bore throughout, a plurality of upwardly facing drive slots for complementary engagement with the drive lugs when the tool is in the extended position, an internally splined center section located in slidable engagement with the splined shaft, a plurality of slots, and a connection at its bottom for attachment to a drill string component; and a plurality of lugs located one each within the slots and extending outwardly when the tool is moved from the retracted position to the extended position.

21. A drilling tool with extendable elements, as described in claim 20, further comprising:

the lugs having curved inner surfaces engagable with the housing assembly when the tool is in the retracted position; and, the curved inner surfaces engaging the mandrel assembly when the tool is in the extended position.

22. A drilling tool with extendable elements, as described in claim 21, further comprising:

the mandrel assembly having a tubular upper mandrel portion;

the housing assembly having a tubular lower mandrel portion located in axial slidable engagement with the upper mandrel;

the curved inner surfaces engagable with the outside diameter of the tubular lower mandrel when the tool is in a retracted position; and, the curved inner surfaces engaging the outside diameter of the tubular upper mandrel when the tool is in an extended position.

23. A drilling tool with extendable elements, as described in claim 20, further comprising:

the mandrel assembly having an externally tapered bottom; and, bottom when the tool is in the retracted position, the lugs having curved inner surfaces wherein the externally tapered bottom traverses the conically tapered surfaces and the curved inner surfaces to force the lugs outward when the tool is moved from the retracted position to the extended position.

24. The drilling tool with extendable elements, according to claim 20, further comprising:

the mandrel assembly having an upwardly facing mandrel shoulder; and, the housing assembly having a downwardly facing drive cap shoulder such that when a lifting force is applied to the upper connection, the mandrel shoulder engages the drive cap shoulder to transmit the lifting force to the housing assembly.

25. The drilling tool with extendable elements, according to claim 20, wherein each of the lugs has an exterior taper along the majority of its perimeter such that the distance a lug may extend through a slot is limited by engagement with the slot.

26. The drilling tool with extendable elements, according to claim 20, wherein;

each of the lugs has an exterior taper along the majority of its perimeter; and, each of the slots extends in tapered reduction radially outwardly along the majority of its perimeter, such that the distance a lug may extend through a slot is limited by substantial engagement of the lug perimeter with the slot perimeter.

27. The drilling tool with extendable elements, according to claim 20, further comprising:

a plurality of cutting elements attached to the surface of each of the lugs, wherein the hardness of the cutting element material is harder than the material in the wellbore to be enlarged.

28. The drilling tool with extendable elements, according to claim 27, wherein the plurality of cutting elements comprises tungsten carbide inserts.

29. The drilling tool with extendable elements, according to claim 27, wherein the plurality of cutting elements comprises polycrystalline diamond compact cutters.

30. The drilling tool with extendable elements, according to claim 27, wherein the plurality of cutting elements comprises natural diamonds.

31. The drilling tool with extendable elements, according to claim 20, further comprising:

a stabilizer wear surface attached to the surface of each of the lugs, wherein the hardness of the wear surface is harder than the material in the wellbore to be engaged.

32. The drilling tool with extendable elements, according to claim 31, wherein the stabilizer wear surface comprises a coating of a hardmetal.

33. The drilling tool with extendable elements, according to claim 31, wherein the stabilizer wear surface comprises a plurality of tungsten carbide inserts.

34. The drilling tool with extendable elements, according to claim 31, wherein the stabilizer wear surface comprises a plurality of polycrystalline diamond compacts.

35. The drilling tool with extendable elements, according to claim 31, wherein the stabilizer wear surface comprises a plurality of natural diamonds.

36. The drilling tool with extendable elements, according to claim 20, further comprising:

at least one shear pin located between the mandrel assembly and the housing assembly to retain the tool in the retracted position until the shear pin is sheared by applying at least a predetermined minimum weight on the tool.

37. The drilling tool with extendable elements, according to claim 20, further comprising:

a pressure indicator comprising a flow restricting device located inside of the mandrel assembly central bore such that upon relative movement of the mandrel assembly towards the housing assembly, the pressure indicator causes a detectable increase in pressure associated with moving the tool from the retracted position to the extended position.

38. The drilling tool with extendable elements, according to claim 20, wherein the housing assembly further comprises:

at least one fluid course intersecting the housing assembly central bore and being directed upwards to the exterior of the housing assembly; and, a nozzle receptacle at the radial end of each fluid course in the housing assembly.

39. The drilling tool with extendable elements, according to claim 20, further comprising:

a hydraulic lock pin assembly located in the mandrel assembly, having a hydraulic piston responsive to fluid pressure in the tool; and, a bore hole in the mandrel assembly to receive the hydraulic piston to lock the tool in the extended position.

40. A drilling tool with extendable elements, being movable between a retracted position and an extended position, comprising:

a mandrel assembly having an upper connection at the top for attachment to a drill string component, and a central bore throughout;

a housing assembly located in axially slidable, and rotationally engaged relation with the mandrel assembly, a central bore throughout, a plurality of slots extending in tapered reduction radially outwardly along the majority of their perimeter, and a connection at its bottom for attachment to a drill string component; and, a plurality of lugs located one each within the slots, each of the lugs having an exterior taper along the majority of its perimeter, such that the distance a lug may extend through a slot is limited by matching engagement of the lug perimeter with the slot perimeter when the tool is moved into the extended position.

41. A drilling tool with extendable elements, as described in claim 40, further comprising:

the lugs having curved inner surfaces engagable with the housing assembly when the tool is in the retracted position; and, the curved inner surfaces engaging the mandrel assembly when the tool is in the extended position.

42. A drilling tool with extendable elements, as described in claim 41, further comprising:

the mandrel assembly having a tubular upper mandrel portion;

the housing assembly having a tubular lower mandrel portion located in axial slidable engagement with the upper mandrel;

the curved inner surfaces engagable with the outside diameter of the tubular lower mandrel when the tool is in a retracted position; and, the curved inner surfaces engaging the outside diameter of the tubular upper mandrel when the tool is in an extended position.

43. A drilling tool with extendable elements, as described in claim 40, further comprising:

the mandrel assembly having a plurality of drive lugs facing downwardly, and a splined shaft extending downwardly of the drive lugs; and, the housing assembly having a plurality of upwardly facing drive slots for complementary engagement with the drive lugs when the tool is in the extended position, and an internally splined center section located in slidable engagement with the splined shaft.

44. A drilling tool with extendable elements, as described in claim 40, further comprising:

the mandrel assembly having an externally tapered bottom; and, the lugs having a conically tapered surface portion engagable with the externally tapered bottom when the tool is in the retracted position, the lugs having curved inner surfaces wherein the externally tapered bottom traverses the curved inner surface to force the lugs outward when the tool is moved from the retracted position to the extended position.

45. The drilling tool with extendable elements, according to claim 40, further comprising:

the mandrel assembly having an upwardly facing mandrel shoulder; and, the housing assembly having a downwardly facing drive cap shoulder such that when a lifting force is applied to the upper connection, the mandrel shoulder engages the drive cap shoulder to transmit the lifting force to the housing assembly.

46. The drilling tool with extendable elements, according to claim 40, further comprising:

a plurality of cutting elements attached to the surface of each of the lugs, wherein the hardness of the cutting element material is harder than the material in the wellbore to be enlarged.

47. The drilling tool with extendable elements, according to claim 46, wherein the plurality of cutting elements comprises tungsten carbide inserts.

48. The drilling tool with extendable elements, according to claim 46, wherein the plurality of cutting elements comprises polycrystalline diamond compact cutters.

49. The drilling tool with extendable elements, according to claim 46, wherein the plurality of cutting elements comprises natural diamonds.

50. The drilling tool with extendable elements, according to claim 40, further comprising:

a stabilizer wear surface attached to the surface of each of the lugs, wherein the hardness of the wear surface is harder than the material in the wellbore to be engaged.

51. The drilling tool with extendable elements, according to claim 50, wherein the stabilizer wear surface comprises a coating of a hardmetal.

52. The drilling tool with extendable elements, according to claim 50, wherein the stabilizer wear surface comprises a plurality of tungsten carbide inserts.

53. The drilling tool with extendable elements, according to claim 50, wherein the stabilizer wear surface comprises a plurality of polycrystalline diamond compacts.

54. The drilling tool with extendable elements, according to claim 50, wherein the stabilizer wear surface comprises a plurality of natural diamonds.

55. The drilling tool with extendable elements, according to claim 40, further comprising:

at least one shear pin located between the mandrel assembly and the housing assembly to retain the tool in the retracted position until the shear pin is sheared by applying at least a predetermined minimum weight on the tool.

56. The drilling tool with extendable elements, according to claim 40, further comprising:

a pressure indicator comprising a flow restricting device located inside of the mandrel assembly central bore such that upon relative movement of the mandrel assembly towards the housing assembly, the pressure indicator causes a detectable increase in pressure associated with moving the tool from the retracted position to the extended position.

57. The drilling tool with extendable elements, according to claim 40, wherein the housing assembly further comprises:

at least one fluid course intersecting the housing assembly central bore and being directed upwards to the exterior of the housing assembly; and, a nozzle receptacle at the radial end of each fluid course in the housing assembly.

58. The drilling tool with extendable elements, according to claim 40, further comprising:

a hydraulic lock pin assembly located in the mandrel assembly, having a hydraulic piston responsive to fluid pressure in the tool; and, a bore hole in the mandrel assembly to receive the hydraulic piston to lock the tool in the extended position.

59. A drilling tool with extendable elements, being movable between a retracted position and an extended position, comprising:

a drive shaft having an upper drive shaft connection at the top for attachment to a drill string component, a central bore extending longitudinally throughout, a plurality of drive lugs facing downwardly, a splined shaft extending downwardly of the drive lugs, and a lower drive shaft connection on the bottom of the splined shaft;

a tubular upper mandrel attached to the lower drive shaft connection at its top end, a central bore throughout, and a tapered bottom at its lower end;

a drive cap having a plurality of upwardly facing drive slots at its top for complementary engagement with the drive lugs, an internally splined center section located in slidable engagement with the splined shaft, and having a drive cap connection on its bottom end;

an upper housing having a central bore extending longitudinally throughout, a top connection for complementary attachment to the drive cap connection, a bottom connection at its bottom end, the upper housing having a plurality of slots, wherein each of the slots has a tapered perimeter extending in tapered reduction radially outwardly;

a lower mandrel located in axially slidable fit within the upper mandrel central bore, the lower mandrel having a central bore extending longitudinally throughout, the lower mandrel having a connection at its bottom end;

a seal between the lower mandrel and the upper mandrel;

a lower housing having a central bore extending longitudinally throughout, the lower housing having a double connection at its top for external attachment to the upper housing bottom connection and internal attachment to the lower mandrel connection, the lower housing having a connection at its bottom for attachment to a drill string component; and, a plurality of lugs located one each within the slots, each of the lugs having an exterior taper along the majority of its perimeter, such that the distance a lug may extend through a slot is limited by engagement of the lug perimeter with the slot perimeter when the tool is moved into the extended position.

60. The drilling tool with extendable elements, according to claim 59, further comprising:

the mandrel assembly having an upwardly facing mandrel shoulder; and, the housing assembly having a downwardly facing drive cap shoulder such that when a lifting force is applied to the upper connection, the mandrel shoulder engages the drive cap shoulder to transmit the lifting force to the housing assembly.

61. The drilling tool with extendable elements, according to claim 59, further comprising:

a plurality of cutting elements attached to the surface of each of the lugs, wherein the hardness of the cutting element material is harder than the material in the wellbore to be enlarged.

62. The drilling tool with extendable elements, according to claim 61, wherein the plurality of cutting elements comprises tungsten carbide inserts.

63. The drilling tool with extendable elements, according to claim 61, wherein the plurality of cutting elements comprises polycrystalline diamond compact cutters.

64. The drilling tool with extendable elements, according to claim 61, wherein the plurality of cutting elements comprises natural diamonds.

65. The drilling tool with extendable elements, according to claim 59, further comprising:

a stabilizer wear surface attached to the surface of each of the lugs, wherein the hardness of the wear surface is harder than the material in the wellbore to be engaged.

66. The drilling tool with extendable elements, according to claim 65, wherein the stabilizer wear surface comprises a coating of a hardmetal.

67. The drilling tool with extendable elements, according to claim 65, wherein the stabilizer wear surface comprises a plurality of tungsten carbide inserts.

68. The drilling tool with extendable elements, according to claim 65, wherein the stabilizer wear surface comprises a plurality of polycrystalline diamond compacts.

69. The drilling tool with extendable elements, according to claim 65, wherein the stabilizer wear surface comprises a plurality of natural diamonds.

70. The drilling tool with extendable elements, according to claim 59, further comprising:

at least one shear pin located between the mandrel assembly and the housing assembly to retain the tool in the retracted position until the shear pin is sheared by applying at least a predetermined minimum weight on the tool.

71. The drilling tool with extendable elements, according to claim 59, further comprising:

a pressure indicator comprising a flow restricting device located inside of the mandrel assembly central bore such that upon relative movement of the mandrel assembly towards the housing assembly, the pressure indicator causes a detectable increase in pressure associated with moving the tool from the retracted position to the extended position.

72. The drilling tool with extendable elements, according to claim 59, wherein the housing assembly further comprises:

at least one fluid course intersecting the housing assembly central bore and being directed upwards to the exterior of the housing assembly; and, a nozzle receptacle at the radial end of each fluid course in the housing assembly.

73. The drilling tool with extendable elements, according to claim 59, further comprising:

a hydraulic lock pin assembly located in the mandrel assembly, having a hydraulic piston responsive to fluid pressure in the tool; and, a bore hole in at least one drive slot to receive the hydraulic piston to lock the tool in the extended position.

* * * * *